US006254297B1

(12) United States Patent
Frazier

(10) Patent No.: US 6,254,297 B1
(45) Date of Patent: Jul. 3, 2001

(54) MARKER PEN DEVICES

(76) Inventor: Thomas G. Frazier, 17 Weldon Dr., Doylestown, PA (US) 18901

( * ) Notice: Subject to any disclaimer, the term of this patent is extended or adjusted under 35 U.S.C. 154(b) by 0 days.

(21) Appl. No.: 09/703,244

(22) Filed: Nov. 1, 2000

(51) Int. Cl.[7] ..... B43K 5/14

(52) U.S. Cl. ..... 401/133; 411/132; 222/541.1; 206/219; 366/130

(58) Field of Search ..... 401/132, 133, 401/134, 135; 206/219, 220, 221, 222; 222/541.1, 541.2, 80; 366/130, 343

(56) References Cited

U.S. PATENT DOCUMENTS

D. 373,384 * 9/1996 Frazier ..... D19/66
D. 413,370 * 9/1999 Frazier ..... D4/144
D. 416,389 * 11/1999 Frazier ..... D4/114
4,064,428 * 12/1977 Van Zandt ..... 362/34
4,784,506 * 11/1988 Koreska et al. ..... 401/132
5,154,320 * 10/1992 Bolduc ..... 222/145
5,199,808 * 4/1993 Gueret ..... 401/133
5,445,462 * 8/1995 Johnson et al. ..... 401/132
5,508,893 * 4/1996 Nowark et al. ..... 362/34
5,509,744 * 4/1996 Frazier ..... 401/132

* cited by examiner

*Primary Examiner*—Gregory L. Huson
*Assistant Examiner*—Huyen Le
(74) *Attorney, Agent, or Firm*—Zachary T. Wobensmith, III

(57) ABSTRACT

Marker pen devices for dispensing moisture sensitive or volatile liquids, which include an outer tube open at one end, of rigid plastic or aluminum with a sealed glass ampoule inside the tube which has liquid therein to be dispensed which may contain a metallic glass ball for mixing and/or breaking the ampoule for freeing the liquid, for dispensing through a spring action nib valve, which closes off the open end of the tube, and in an alternate embodiment may have an externally mounted slide ring activator to distort said tube and crush the ampoule.

8 Claims, 3 Drawing Sheets

PRIOR ART

MARKER PEN DEVICES

BACKGROUND OF THE INVENTION

1. Field of the Invention

This invention relates to marker pen devices of the type which contain volatile or unstable liquids in a sealed glass tube, which is broken to permit the liquid to be dispensed through a spring action mb valve.

2. Description of the Prior Art

Marker or paint type pens which contain volatile liquids are available in the prior art. Such pens typically include an impervious tube, sealed at one end, and capped at the other open end with a spring action valve. The valve is activated by depressing a rigid or porous marking or painting nib of well known type. These pens are available from a variety of manufacturers such as Flocon, Inc., J.P. Nissen Co., Ideal Stencil machine and Tape Co., and Aubex Corporation.

The prior art pens are typically constructed by filling the tube with a liquid, which could be a volatile or unstable liquid, and sealed at the open end by inserting a spring loaded nib valve, which fits tightly in the tube, and sealing the nib valve with a hood.

To use the pen, the hood is removed, the pen is inverted and the nib is depressed opening the spring loaded valve, allowing the liquid to flow through or around the nib and applied to the surface to be marked or painted.

While these pens may be suitable for many liquids, they are not satisfactory for sealing and dispensing very volatile or unstable liquids that cure or polymerize through the introduction of atmospheric water vapor as a catalyst for polymerization. These pens do not satisfactorily store or dispense liquids containing isocynates, such as polymeric diisocynate or hexamethylene diisocynate or cyanoacrylate adhesives.

One of the problem with the described prior art pens is that the valve construction may allow air and atmospheric water vapor to enter the pen, and cure the liquid or allow the liquid to evaporate from the pen during storage prior to initial use.

This sealing defect has restricted the use of these pens from liquids that are sensitive to moisture or are volatile. In effect, it is not practical to use these pens with the described liquids due to their very short shelf life.

In the pens of the invention the volatile liquids are stored in a sealed impervious glass tube, which may contain a metallic ball for mixing and breaking of the tube for dispensing the liquid through a spring loaded nib valve. Alternatively, the tube may be crushed by an external slide ring activator of the type shown in my prior U.S. Pat. Nos. DES. 413,730 and DES. 416,389.

The new pen structure provides consistent results, does not suffer from the disadvantages of the prior art, and provides many other advantages.

SUMMARY OF THE INVENTION

This invention relates to a marker pen device which includes an outer tube open at one end, which may be of rigid plastic or aluminum, an inner onion skinned hermetically sealed glass ampoule or tube inside the outer tube filled with a liquid to be dispensed, and a spring loaded nib valve carried in the outer tube sealing off the open end. A metallic ball may be carried in the glass ampoule, to mix the liquid and break the ampoule, or a slide ring activator may be carried on the outer tube, to selectively crush the ampoule to permit the liquid to flow out the nib valve.

The principal object of the invention is to provide a marker pen device that is suitable for storing and dispensing moisture sensitive, or volatile liquids.

A further object of the invention is to provide a marker pen device that is consistent in operation.

A further object of the invention is to provide a marker pen device that has a long shelf life.

A further object of the invention is to provide a marker pen device that is simple and inexpensive to construct.

A further object of the invention is to provide a marker pen device that is sturdy and reliable in operation.

A further object of the invention is to provide a marker pen device that can contain a metallic ball for mixing and releasing the liquid to be dispensed.

A further object of the invention is to provide a marker pen device that may have an external slide ring activator to break the liquid containing glass tube, to allow the liquid contained in the tube to be dispensed through the nib valve.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents, which operate and function in substantially the same way to bring about the same result.

Figure 1:
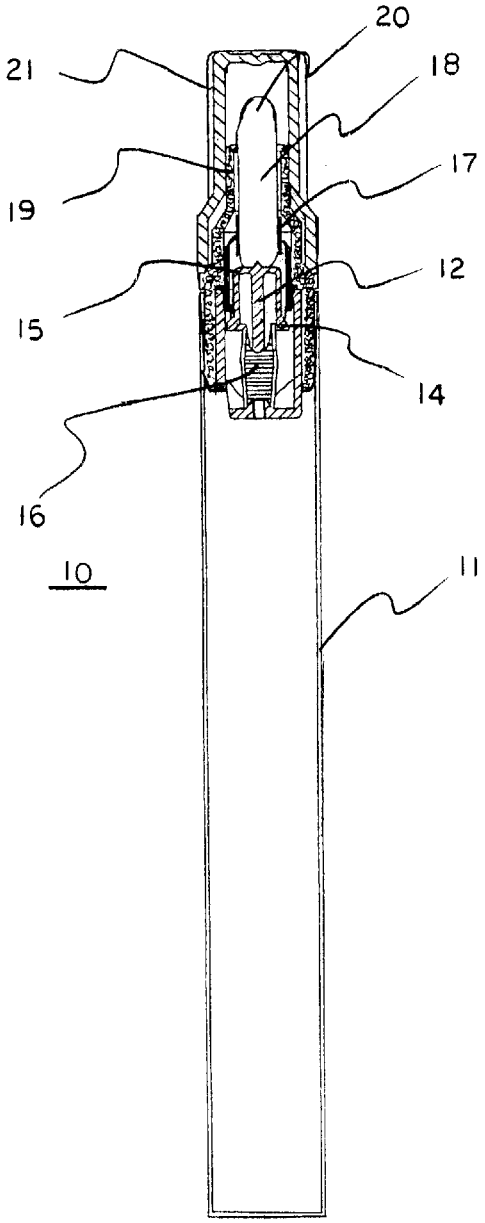
FIG. 1 is a vertical sectional view of a prior art marker pen device.
Figure 2:
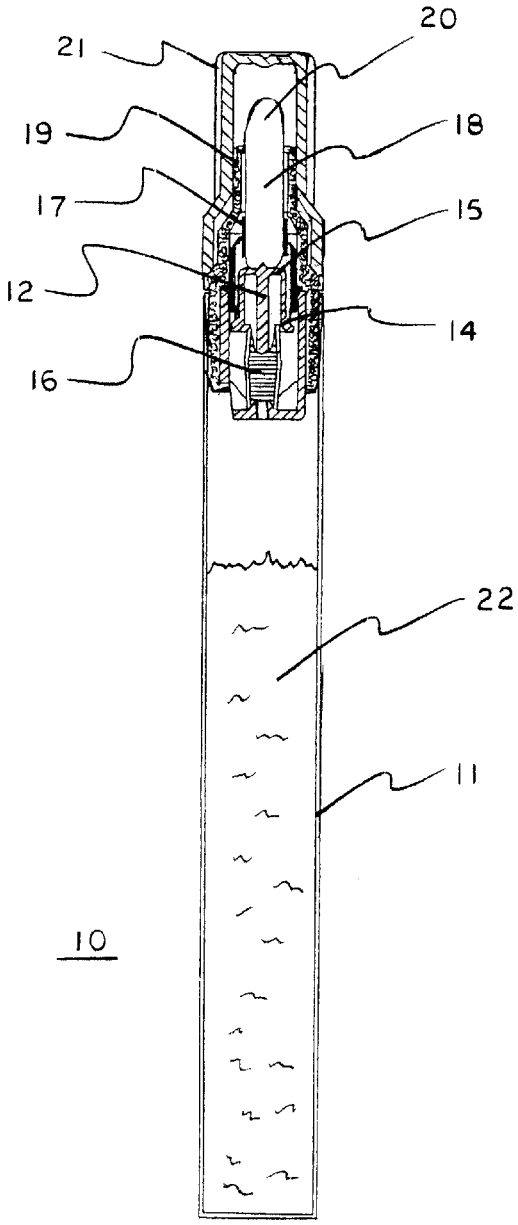
FIG. 2 is a vertical sectional view of the marker pen device of FIG. 1 with liquid therein.

Referring now more particularly to FIGS. 1 and 2 of the drawings, a prior art marker pen device 10 is therein illustrated.

The device 10 includes an outer rigid tube 11 open at one end, and which has a spring action valve 12 engaged therewith sealing off the open end of tube 11.

The valve 12 has an outer body 14 preferably of polypropylene plastic or acetal resin, or other such inert plastic, with a spring cup 15, and a spring 16 engaged therewith preferably of stainless steel.

The spring cup 15 has a flex seal 17 engaged therewith, and with a porous nib 18 of well known type, and which can be of acrylic, polyester, nylon or foam as desired. The nib 18 is encased therearound by a closure 19, through which the tip 20 of nib 18 extends. The nib 18 is enclosed by a removable hood 21, which also engages the open end of the tube 11. The hood 21 is preferably formed of acetal or polypropylene plastic.

The tube 11 is filled with a liquid 22 of well known type, which is to be dispensed through nib 18, to be described.

In use, the hood 21 is removed, the device 10 is inverted, and tip 20 of nib 18 pressed in thereby allowing liquid to flow through or around the nib 18 and onto the surface (not shown) to be painted or primed.

Figure 3:
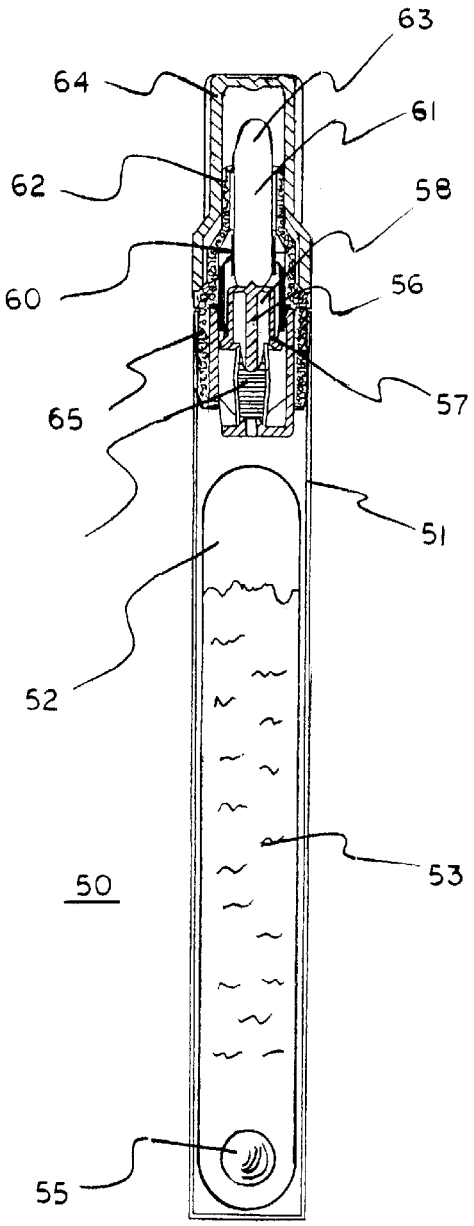
FIG. 3 is a vertical sectional view of one embodiment of the marker pen device of the invention.
Figure 3A:
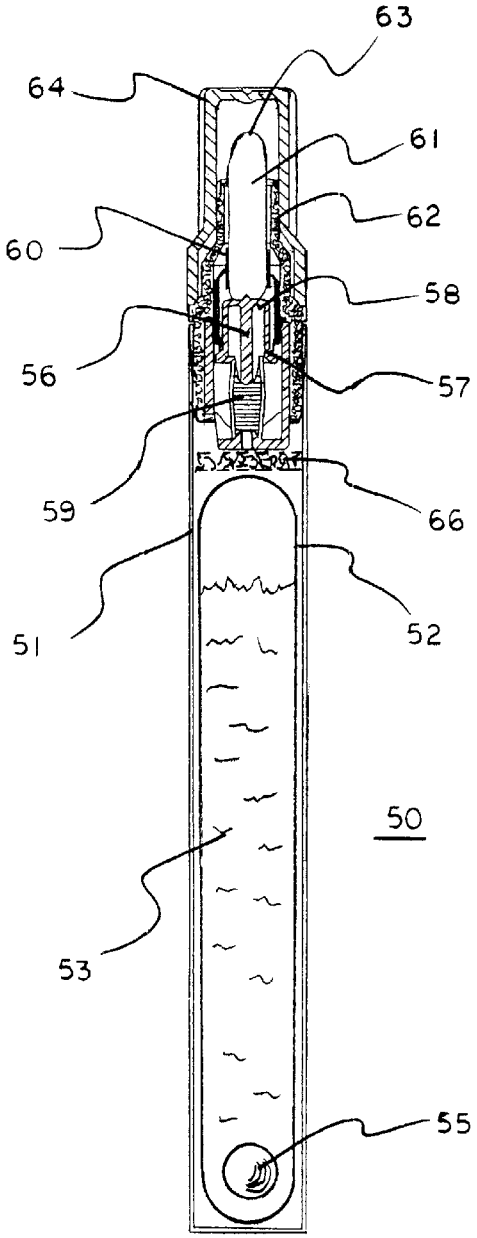
FIG. 3A is a view similar to FIG. 3 illustrating a modification to the device of the invention.

Referring now to FIGS. 3 and 3A one embodiment of the marker pen device 50 of the invention is therein illustrated.

The device 50 includes an outer tube 51, open at one end, which may be of rigid plastic of well known type, or of aluminum.

An onion skinned glass tube or ampoule 52 is provided inside tube 51, which may contain a volatile, and/or unstable liquid 53 that is susceptible to contamination by water vapor, which liquid 53 may contain isocynates, or cyanoacrylate adhesives of well known type.

If desired, the ampoule 52 may contain an anhydrous head of inert gas over said liquid (not shown) such as nitrogen or carbon dioxide, which serves to extend the shelf life of the liquid 53.

A metallic ball 55, preferably of stainless steel, is provided in ampoule 52 which is useful for mixing the liquid 53 if it is a two phase liquid, or contains suspended solids which should be dispersed, which can be accomplished by shaking the pen device 50 to move the ball 55 in the liquid 53.

The marker pen device 50 has a spring action valve 56 engaged therewith, similar to valve 12, sealing off the open end of tube 51.

The valve 56 has an outer body 57, preferably of polypropylene plastic, with a spring cup 58, and a spring 59 engaged therewith, preferably of stainless steel.

The spring cup 58 has a flex seal 60 engaged therewith, and with a porous or solid nib 61 of well known type, and which can be of acrylic, polyester, nylon or foam as desired.

The nib 61 is encased therearound by a closure 62 through which the tip 63 of nib 61 extends.

The nib 61 is enclosed by a removable hood 64, which also engages the open end 65 of the tube 51.

The hood 64 is preferably formed of acetal or polypropylene plastic.

In use the device 50 is shaken to free up ball 55, which serves to mix the liquid 53 and to disperse any solids in the liquid 53.

When the liquid 53 is totally mixed and with hood 64 in place, the pen device 50 is thrust downwardly several times against a hard surface, until the ball 55 hits the edge of the ampoule 52, breaking the glass and allowing the liquid 53 to escape from the ampoule 52.

The hood 64 can then be removed and the spring action nib valve 56 used as described for the prior art devices of FIGS. 1 and 2, with the valve action satisfactory to keep the liquid 53 in condition for use for several days or weeks as required.

Referring more specifically to FIG. 3A, the pen device 50 is provided with a filter plug 66 of well known type, which is located between the spring action valve 56, and the ampoule 52 preventing any glass shards from entering valve 56.

Figure 4:
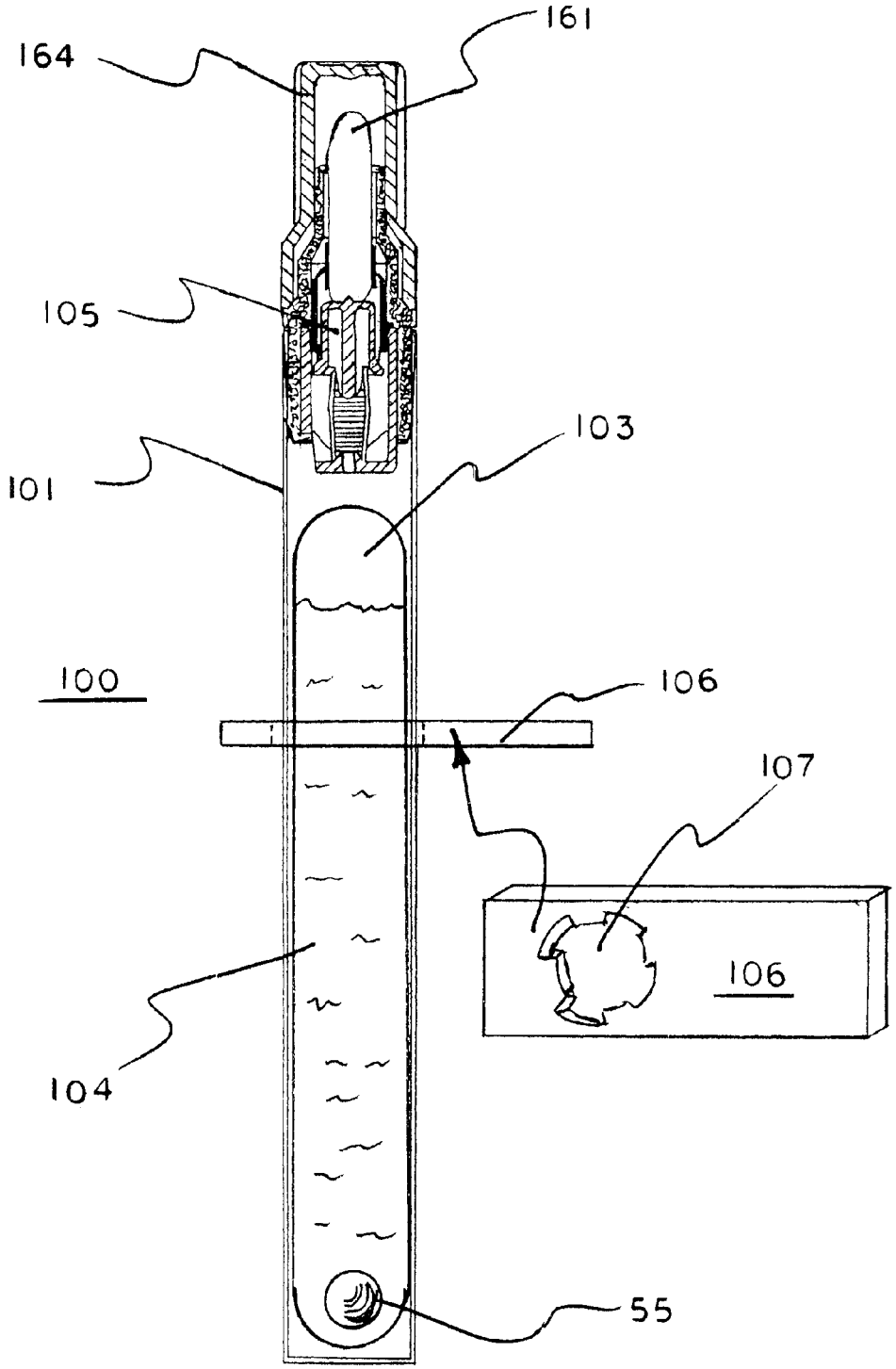
FIG. 4 is a vertical sectional view of another embodiment of the device of FIG. 3.

Referring now to FIG. 4 another embodiment of marker pen device 100 is therein illustrated.

The device 100 is similar to devices 10 and 50, with an outer tube 101, open at one, end of rigid plastic or aluminum, with a glass ampoule 103 therein containing liquid 104 to be dispensed. The ampoule 103 may contain a metallic ball 55 for mixing the liquid 104 if desired. The tube 101 and the ampoule 103 are in close proximity.

A spring action valve 105 is provided in the end of tube 101 of similar construction to valves 12 and 56.

A hood 164 and a nib 161 are provided similar to that described for devices 10 and 50.

A slide ring activator 106 is provided similar to that shown in my prior patents, No. 5,509,744, Nos. DES. 413,730 and DES. 416,389, which activator is of rectangular shape, with an opening 107 to fit over tube 101. To activate the device 100 the slide ring activator is twisted on tube 101 to distort the tube, and break the glass ampoule 103, thereby releasing the liquid to be dispensed as described for marker pen devices 10 and 50.

It will thus be seen that marker pen devices have been provided with which the objects of the invention are achieved.

We claim:

1. A marker pen device for dispensing moisture sensitive or volatile liquids which comprises, an outer tube open at one end, a sealed glass ampoule in said tube having liquid therein to be dispensed, spring action nib valve means in said tube open end for dispensing said liquid, a removable hood that seals off the marker nib, and a metallic ball in said ampoule for liquid mixing and for breaking said ampoule to permit dispensing of said liquid through said valve means.

2. A marker pen device as defined in claim 1 in which, said ampoule has a head of anhydrous inert gas over said liquid.

3. A marker pen device as defined in claim 1 in which, a filter plug is provided in said tube between said ampoule and said valve.

4. A marker pen device for dispensing moisture sensitive or volatile liquids which comprises, an outer tube open at one end, a sealed glass ampoule in said tube having liquid therein to be dispensed, spring action nib valve means in said tube open end for dispensing said liquid, a removable hood that seals off the marker nib, and slide ring activator means on said tube for distorting said tube to crush said ampoule to free said liquid for dispensing through said valve means.

5. A marker pen device as defined in claims 1 or 4 in which, said outer tube is of rigid plastic.

6. A marker pen device as defined in claims 1 or 4 which, said outer tube is of aluminum.

7. A marker pen device as defined in claims 1 or 4 wherein, said liquid may contain one or more isocynates.

8. A marker pen device as defined in claims 1 or 4 wherein, said liquid may contain cyanoacrylates.

* * * * *